United States Patent [19]

Weidmann

[11] Patent Number: 4,921,243

[45] Date of Patent: May 1, 1990

[54] MOTION APPARATUS

[76] Inventor: Ulrich Weidmann, Steinackerstrasse 9, CH-8302 Kloten, Switzerland

[21] Appl. No.: 255,098

[22] Filed: Oct. 7, 1988

[30] Foreign Application Priority Data

Oct. 7, 1987 [CH] Switzerland ..... 3913/87

[51] Int. Cl.[5] ..... A63B 23/04

[52] U.S. Cl. ..... 272/96; 128/25 B

[58] Field of Search ..... 272/96, 97, 70, 73, 272/132; 128/25 R, 25 B

[56] References Cited

U.S. PATENT DOCUMENTS

| | | | |
|---|---|---|---|
| 3,022,071 | 2/1962 | Malone et al. | 272/96 |
| 3,316,898 | 5/1967 | Brown | 128/25 B |
| 3,318,304 | 5/1967 | Gurewich | 128/25 B |
| 3,741,540 | 6/1973 | Shimuzu | 272/96 |
| 3,789,836 | 2/1974 | Girten | 128/25 B |
| 3,917,261 | 11/1975 | Small et al. | 272/96 |
| 4,077,626 | 3/1978 | Newman | 272/132 |
| 4,159,111 | 6/1979 | Lowth | 272/96 |
| 4,542,898 | 9/1985 | Grushkin | 272/73 |
| 4,705,028 | 11/1987 | Melby | 272/70 |

FOREIGN PATENT DOCUMENTS

| | | | |
|---|---|---|---|
| 2031742 | 4/1980 | United Kingdom | 272/70 |

*Primary Examiner*—Richard J. Apley
*Assistant Examiner*—David H. Willse
*Attorney, Agent, or Firm*—Thomas W. Speckman; Douglas H. Pauley

[57] ABSTRACT

A motion device which provides circulatory stimulation and therapy of vascular disorders of legs. The motion device comprises two pivoting pedals positioned in a heel area on a base plate. The pedals are connected to a mechanism positioned between the pedals. The mechanism comprises a crank system having a shaft which is parallel to the pivoting axis of the pedals so that the pedals must be moved in push-pull motion. The shaft is connected with a transmission gearing which drives a flywheel. Thus the user of the device can easily overcome the top dead center points during operation. Through the use of a brake operating lightly on the flywheel, the necessary magnitude of force when stepping on the pedals can be sensitively adjusted.

9 Claims, 2 Drawing Sheets

FIG. 1
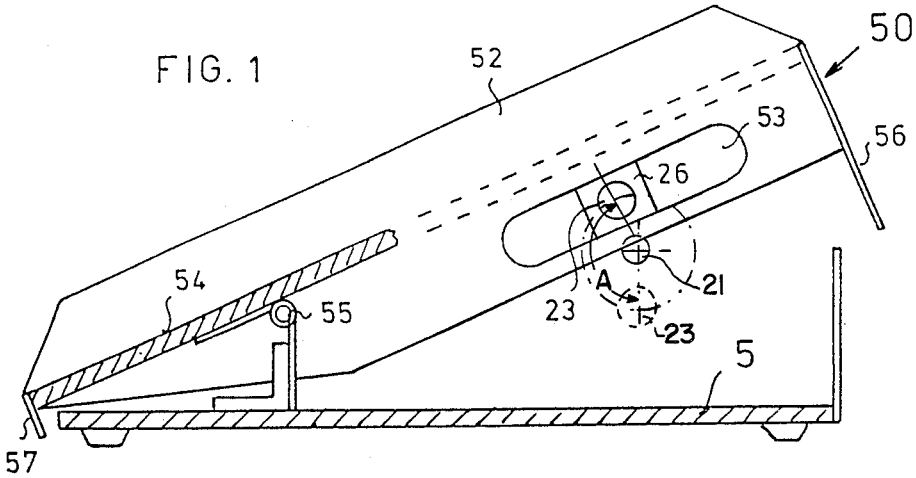
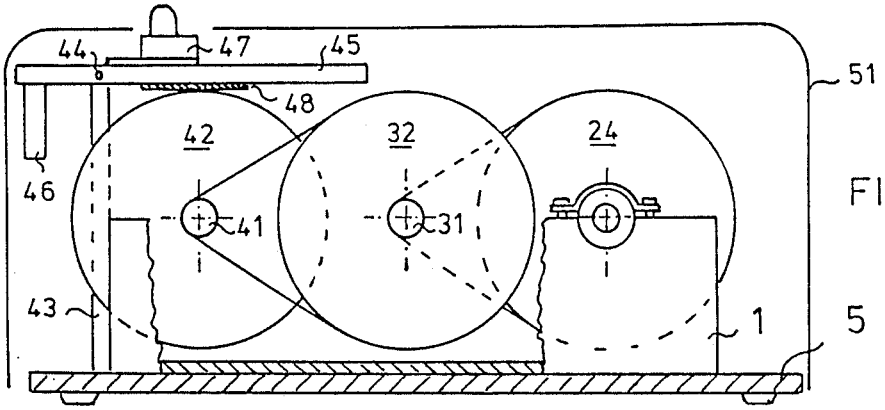
FIG.2
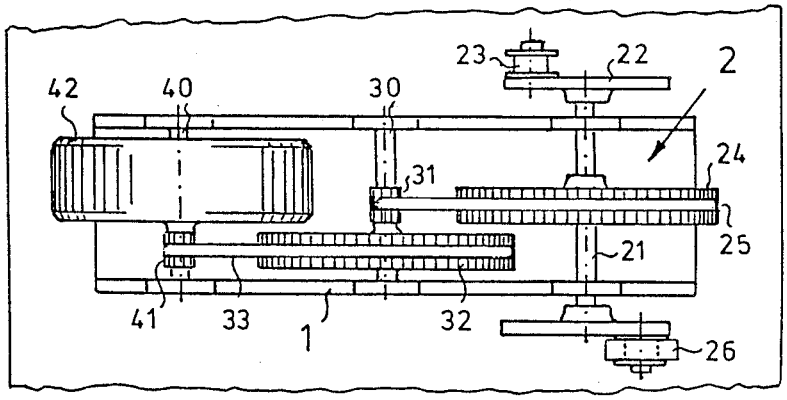
FIG.3

FIG. 4
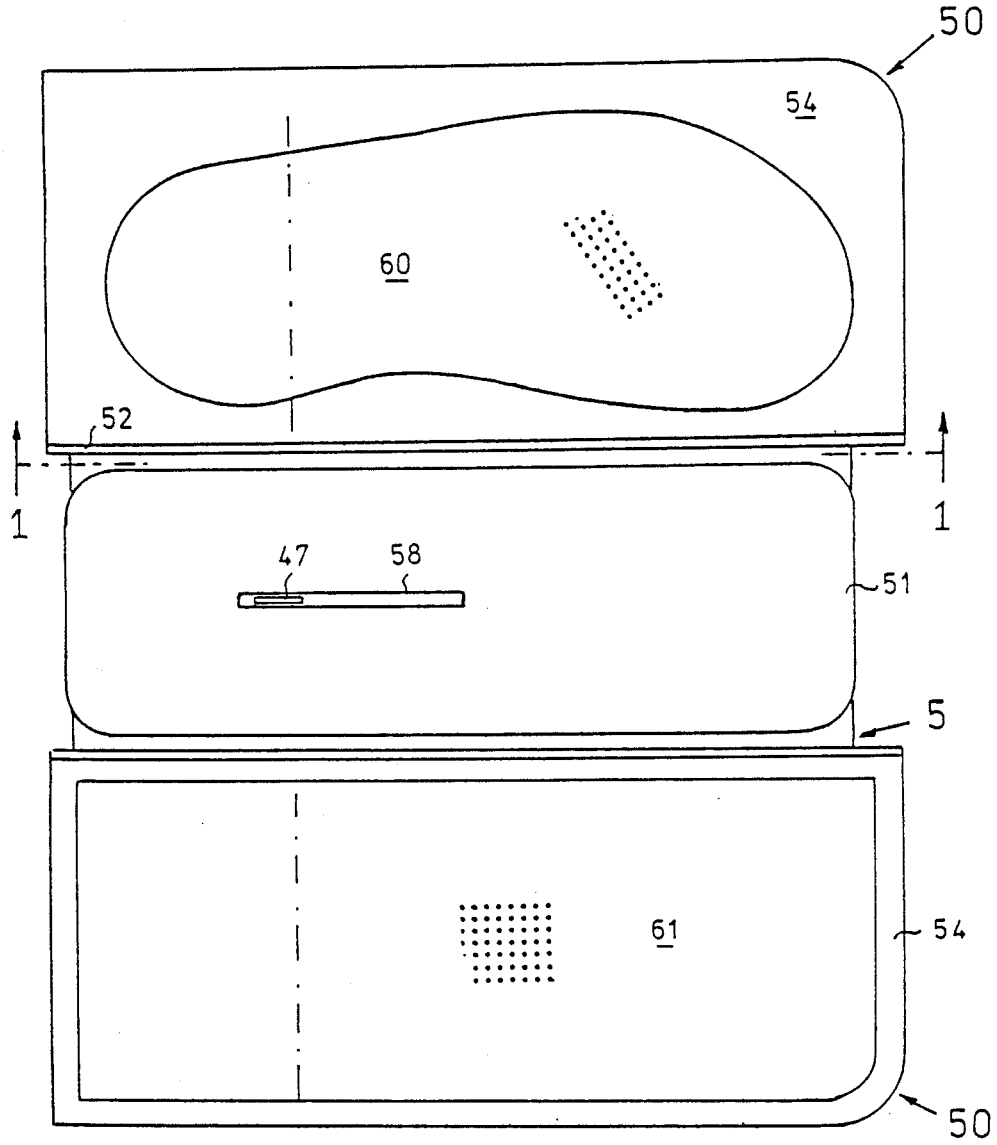
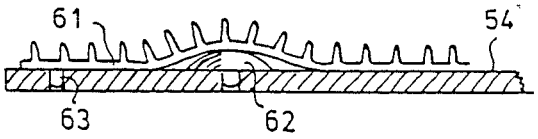
FIG. 5

MOTION APPARATUS

BACKGROUND OF THE INVENTION

1. Field of the Invention

The invention relates to a motion apparatus for circulatory stimulation and for therapy of vascular diseases of the leg.

2. Description of the Prior Art

Unsatisfactory blood circulation in legs particularly occurs with professionals who often sit at a desk and with people who, during the performance of their job, have to stand for extended periods of times. It has been shown that in such cases, blood circulation can be stimulated by means of therapeutic movement of the ankles. Devices have been created which cause a rhythmic tipping movement of the foot relative to the lower leg. It is advantageous if the device forces a tilting movement with a push-pull motion.

U.S. Pat. No. 4,159,111 describes an apparatus having two pedals connected with one another by a two-armed tipping lever, the pivotal axis of which moves perpendicularly to the pivotal axis of the pedal. The magnitude of force for operation can be adjusted by a friction brake on the pivotal axis of a pivotal lever.

In a device taught by GB-PS 2,031,742, pedals are connected to bellows and the bellows are connected with one another by a connecting pipe. While the magnitude of force necessary for activation can be adjusted in a single case by a friction brake, an adjustable valve in the connecting line serves such purpose.

In an apparatus taught by U.S. Pat. No. 3,917,261, a motor drives the pedals in a push-pull motion. With such apparatus, the patient is more passive since the patient's feet are swung up and down about the ankles by the motor.

SUMMARY OF THE INVENTION

This invention relates to a motion device having an active operation which is relatively more pleasant for the user to operate and is therapeutically more effective than the devices described above. In the prior art devices when changing from one foot to the other foot, the apparatus must accelerate from a rest position each time which requires a greater magnitude of torque force than when the apparatus has constant velocity. The known devices require that the user consciously pedal which is a disadvantage if the user desires to simultaneously carry out therapy and other activities such as working while sitting down at a table. This invention relates to a device which reduces the effect of a top dead center point which prevents unconscious stepping without entirely eliminating the need for active operation by the user.

An apparatus according to this invention has a mechanism between the pedals which automatically causes a tilting movement of both pedals.

A motion apparatus according to this invention includes a mechanism attached between two pedals which are pivotally mounted near an area where the heel of a foot rests. The mechanism includes a gear system having a shaft which is parallel to the pivot axis of the pedal. The shaft is connected to a transmission gear which drives a flywheel. The flywheel ensures that the top dead center points are easily overcome. The flywheel permits the application of a comfortable, smooth running and precisely adjustable brake which allows for sensitive adjustment to the magnitude of force for the ankle motion. The pedals can have foot reflex zone massage plates.

BRIEF DESCRIPTION OF THE DRAWINGS

A motion device according to one embodiment of this invention is shown in the simplified drawings wherein:

FIG. 1 shows a side view of a left pedal along line 1—1 as shown in FIG. 4;

FIG. 2 shows a side view of the mechanism;

FIG. 3 shows a top view of the mechansim;

FIG. 4 shows a top view of the complete device; and

FIG. 5 shows a cross-sectional view of a portion of the pedal having a foot reflex zone mat and a massage element.

DESCRIPTION OF THE PREFERRED EMBODIMENTS

FIGS. 2 and 3 show side and top views of the mechanism. The rotable parts are supported in a frame (1). The rotable parts comprise a gear system (2) with a shaft (21) which supports a disk (22) at each end of the shaft (21). A toothed belt (25) drives a toothed pinion (31) which is attached to an intermediate shaft (30). An additional relatively large toothed wheel (32) is attached to the intermediate shaft (30) and a toothed belt (33) drives a toothed pinion (41) on a flywheel shaft (40). The flywheel (42) is attached to the flywheel shaft (40). The transmission gear as constructed creates a transmission ratio of approximately 1 to 30 between the crankshaft (21) and the flywheel shaft (40).

A support mount (43) is constructed on one side of the frame (1) and at point (44) a brake lever (45) is connected. Since the braking force, because of the relatively large transmission ratio, need only be relatively slight in order to achieve an amplified effect, the brake lever (45) is balanced out by a weight (46). Adjustment of the braking force is achieved by shifting the weight (47) along the brake lever (45). On the lower side, the brake lever (45) has a brake lining (48).

The mechanism is attached to a base plate (5) and covered by a hood unit (51). Only the handle of the displaceable counterweight (47) projects out from the hood unit (51) through the aperture slot (58) as shown in FIG. 4.

FIG. 1 shows the internal side of left pedal (50). Aperture slot (53) is applied in one side wall (52), into which a sliding block (26) and the connected crank pin (23) snugly engages. The sliding block (26) is preferably constructed of Teflon so that no lubrication is necessary. In lieu of the sliding blocks (26), ball bearings can also be used. As shown in FIG. 1, as viewed in a vertical plane, an intersection of the centerlines of shaft (21) and both crank pins (23) with the vertical plane, which is perpendicular to base plate (5), forms an angle (A). It is preferred that angle (A) is less than 180° to eliminate a "dead spot" position where the centerlines of crank pins (23) could potentially align and thus cause one pedal (50) to reach a bottom dead center while the opposing pedal (50) reaches a top dead center. Such "dead spot" position is undesirable in a momentum driven device. The pedal (50) has a foot plate (54) which is pivotally connected with the base plate (5) by means of the hinge (55). Apron units (56, 57) form an external covering and are attached at the front and back of the foot plate. One apron unit not shown in FIG. 1 is attached to the externally directed side of the pedal.

A reflex zone massage mat (60) is shaped according to a foot sole and has protrusions of various heights. The mat can be applied to the foot plate. As shown in FIG. 4, the massage mat (60) has protrusions which are indicated by a dotted surface.

A flat reflex zone massage plate (61) which covers nearly the entire foot plate (54) of the pedal is also shown in FIG. 4. As shown in FIG. 5, mushroom-shaped massage elements (62) can be applied at various points of the foot plate to individually stimulate every desired reflex zone of the patient's foot. The mat (60) is attached to the foot plate (54) in a removable manner by means of pegs (63) so that the massage elements (62) can be attached without causing discomfort. Since the crank pins (23) do not lie diametrically opposed to one another, the motion device can always be set into motion from a rest position.

Toothed belts and engageable toothed wheels are used in the transmission gear. It is apparent that other transmission elements can also be used.

I claim:

1. A motion device for circulatory stimulation and for therapy of vascular diseases of legs, said motion device comprising: a base plate on which two pedals (50) are pivotally mounted in a heel area of said base plate, and a mechanism attached between said pedals (50) which forces a positive tilting movement of said pedals (50), said mechanism comprising a gear system (2), having a shaft (21) that is parallel to a pivot axis (55) of one of said pedals (50), and said shaft (21) connected with a transmission gear which drives a flywheel (42).

2. A motion device in accordance with claim 1, wherein said flywheel (42) is connected to cooperate with an adjustable brake secured to a support mount (43), said adjustable brake having a brake lever (45) connected to said support mount (43) at a frame point (44), said brake lever (45) has a weight (46) attached for balancing said brake lever (45).

3. A motion device in accordance with claim 1, wherein a flat reflex zone massage plate (61) is removably attached to and covers at least a portion of a foot plate (54) of said pedals (50) and a massage mat (60) having multiple protrusions is attached to said massage plate (61).

4. A motion device in accordance with claim 3, wherein said massage mat (60) is removable from said pedal (50), and massage elements (62) are inserted at selectable points under said massage mat (60).

5. A motion device in accordance with claim 1, wherein said gear system (2) further comprises said shaft (21) rotably supported in a frame, a disk (22) and crank pins (23) are connected to ends of said shaft (21) in a lateral position next to said frame and a toothed belt wheel (24) is attached to said shaft (21) inside said frame.

6. A motion device in accordance with claim 5 wherein an angle (A) formed in a plane perpendicular to said base plate by points defined by intersection of said plane and a shaft centerline of said shaft (21) and a crank pin centerline of each said crank pin (23) is less than 180 degrees.

7. A motion device in accordance with claim 1, wherein said transmission gear is a two step transmission comprising: an intermediate shaft (30), a first toothed belt wheel (24) mounted on said shaft (21); said first toothed belt wheel (24) driven by a first toothed belt pinion (31), mounted on said intermediate shaft (30), through a first toothed belt (25); and a second toothed belt wheel (32) mounted on said intermediate shaft (30), said second toothed belt wheel (32) driven by a second toothed belt pinion (41), mounted on a flywheel shaft (40), through a second toothed belt (33).

8. A motion device in accordance with claim 1 wherein an angle (A) formed in a plane perpendicular to said base plate by points defined by intersection of said plane and a shaft centerline of said shaft (21) and a crank pin centerline of each said crank pin (23) is less than 180 degrees.

9. A motion device for circulatory stimulation and for therapy for vascular diseases of legs, the motion device comprising: a base plate on which two pedals are pivotally mounted in a heel area of said base plate, a mechanism attached between said pedals (50) which forces a positive tilting movement of said pedals (50), said mechanism comprising a gear system (2) having a shaft (21) parallel to a pivot axis (55) of a pedal (50), said shaft (21) connected with a transmission gear which drives a flywheel (42), and said gear system (2) comprising crank pins (23) having sliding blocks (26) engaged in slots (53) which are applied to said pedals (50), and said slots (53) within an inwardly directed lateral wall (52).

* * * * *